US007146882B1

(12) United States Patent
Chang

(10) Patent No.: US 7,146,882 B1
(45) Date of Patent: Dec. 12, 2006

(54) RATCHET WRENCH

(76) Inventor: Chih-Min Chang, No. 10, Chin Tun Lane, Chin Tun Village, Hua Tan Hsian, Changhua Hsien (TW)

( * ) Notice: Subject to any disclaimer, the term of this patent is extended or adjusted under 35 U.S.C. 154(b) by 0 days.

(21) Appl. No.: 11/203,231

(22) Filed: Aug. 15, 2005

(51) Int. Cl.
*B25B 13/46* (2006.01)

(52) U.S. Cl. ..... 81/63.2; 81/63

(58) Field of Classification Search ..... 81/61–63, 81/63.1, 63.2
See application file for complete search history.

(56) References Cited

U.S. PATENT DOCUMENTS 6,805,027 B1 * 10/2004 Hsien ..... 81/63.2
2002/0005093 A1 * 1/2002 Daigle et al. ..... 81/63.2
2003/0019334 A1 * 1/2003 Wei ..... 81/63.1
2003/0079572 A1 * 5/2003 Ho ..... 81/63.2
2004/0134313 A1 * 7/2004 Liu ..... 81/63.2
2006/0090609 A1 * 5/2006 Chang ..... 81/63.2

* cited by examiner

*Primary Examiner*—Debra S Meislin
(74) *Attorney, Agent, or Firm*—Browdy and Neimark, PLLC

(57) ABSTRACT

A ratchet wrench includes a handle, which has a head and a bearing portion abutted to the head. The head has a through hole and a receiving portion inside the through hole. A driving member is rotatably mounted inside the through hole of the head by a mounting ring having an outside annular groove and a retainer. A pawl is disposed in the receiving portion and meshed with the driving member. A slider is mounted on the pawl and attached to the bearing portion of the handle and inserted into the outside annular groove of the mounting ring for allowing the slider to move along the outside annular groove of the mounting ring.

5 Claims, 3 Drawing Sheets

RATCHET WRENCH

BACKGROUND OF THE INVENTION

1. Field of the Invention

The present invention relates to a handle tool and more particularly, to a ratchet wrench.

2. Description of the Related Art

FIG. 5 shows a conventional ratchet wrench 90. According to this design, the ratchet wrench 90 is comprised of a handle 91, a driving member 92, a mounting ring 93, a C-shaped retainer 94, a pawl 95, a slider 96, and a positioning device 97. The driving member 92 is rotatably mounted in the head 912 of the handle 91. The mounting ring 93 is capped on the driving member 92. The C-shaped retainer 94 mounted in between the mounting ring 93 and the head 912 of the handle 91 to secure the driving member 92 in place. The pawl 95 is mounted in a recessed receiving portion 914 inside the head 912 of the handle 91 and meshed with the driving member 92. The slider 96 has a connecting rod 962 inserted into a locating hole 952 at the pawl 95 so that the slider 96 can be moved to carry the pawl 95. The positioning device 97 is mounted in the recessed receiving portion 914 and stopped at the pawl 95 against the driving member 92.

According to the aforesaid design, the connecting rod 962 of the slider 96 has a polygonal cross section fitting the polygonal cross section of the locating hole 952 of the pawl 95. When fastening the slider 96 to the pawl 96, the user must accurately aim the polygonal cross section of the connecting rod 962 of the slider 96 at the polygonal cross section of the locating hole 952 of the pawl 95. The slider 96 may be fastened to the pawl 95 through several trials. Further, because the slider 96 is disposed in the head 912 and protrudes over the topmost edge of the head 912, the slider 96 tends to be moved accidentally, causing an unnecessary change of the direction of rotation of the driving member 92.

SUMMARY OF THE INVENTION

The present invention has been accomplished under the circumstances in view. It is the main objective of the present invention to provide a ratchet wrench, which is easy to assemble and convenient to use.

According to one aspect of the present invention, the ratchet wrench comprises a handle, a driving member, a mounting ring, a retainer, a pawl, a slider, and a positioning device. The handle has a head at one end and a bearing portion recessed inwards in the top side thereof and abutted to the head. The head of the handle has a through hole and a receiving portion inside the through hole at one side. The driving member is rotatably mounted inside the through hole of the head by the mounting ring and the retainer. The pawl is disposed in the receiving portion of the head and meshed with the driving member. The slider is fastened to the pawl and attached to the bearing portion of the handle and inserted into an outside annular groove around the periphery of the mounting ring for allowing the slider to move along the outside annular groove of the mounting ring.

According to another aspect of the present invention, the slider is attached to the bearing portion of the handle, keeping substantially a top edge thereof in flush with the topmost edge of the head of the handle.

According to still another aspect of the present invention, the pawl has a round locating hole; the slider has a top head attached to the bearing portion of the handle, and a bottom body inserted into the round locating hole of the pawl.

According to still another aspect of the present invention, the slider has two stop blocks extended from two opposite lateral sides of the front flange thereof and selectively stopped at the periphery of the driving member.

According to still another aspect of the present invention, the positioning device comprises a stop rod for stopping against said pawl, and a spring member mounted in a blind hole in the receiving portion inside the head of the handle and stopped between one end of the stop rod and a bottom wall of the blind hole in the arched receiving portion inside the head of the handle to force the stop rod against the pawl.

DETAILED DESCRIPTION OF THE INVENTION

Figure 1:
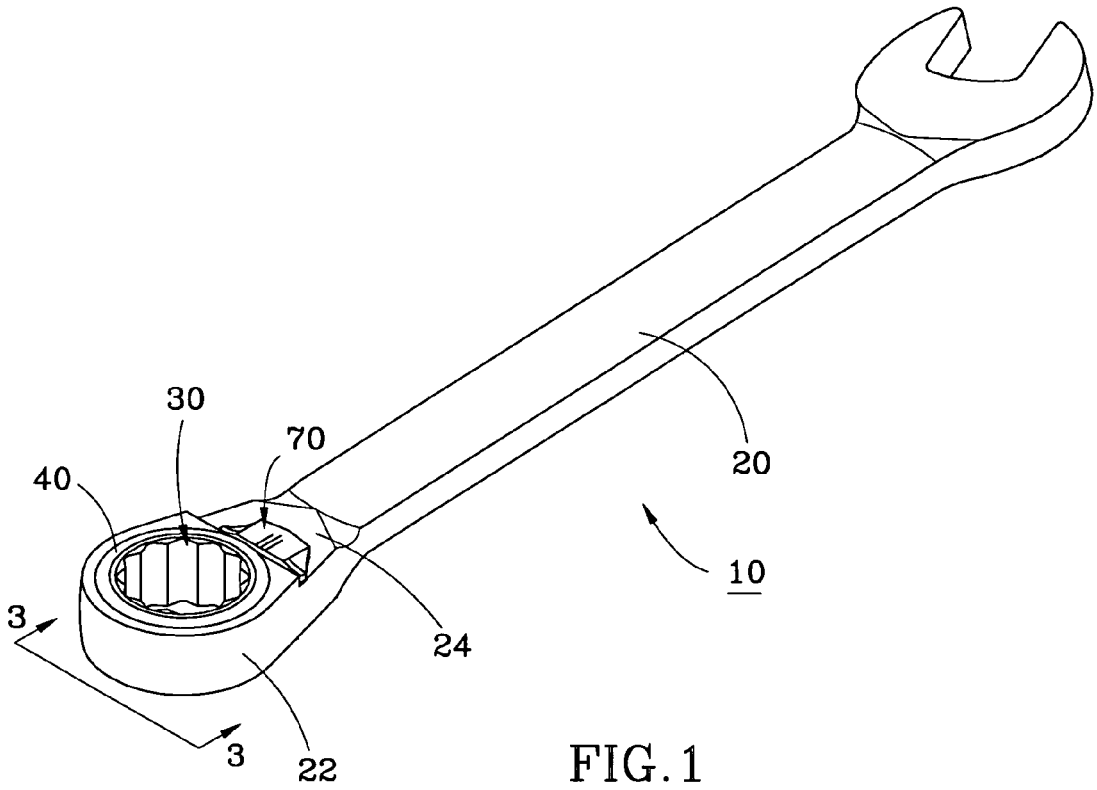
FIG. 1 is a perspective view of a ratchet wrench according to a preferred embodiment of the present invention.
Figure 2:
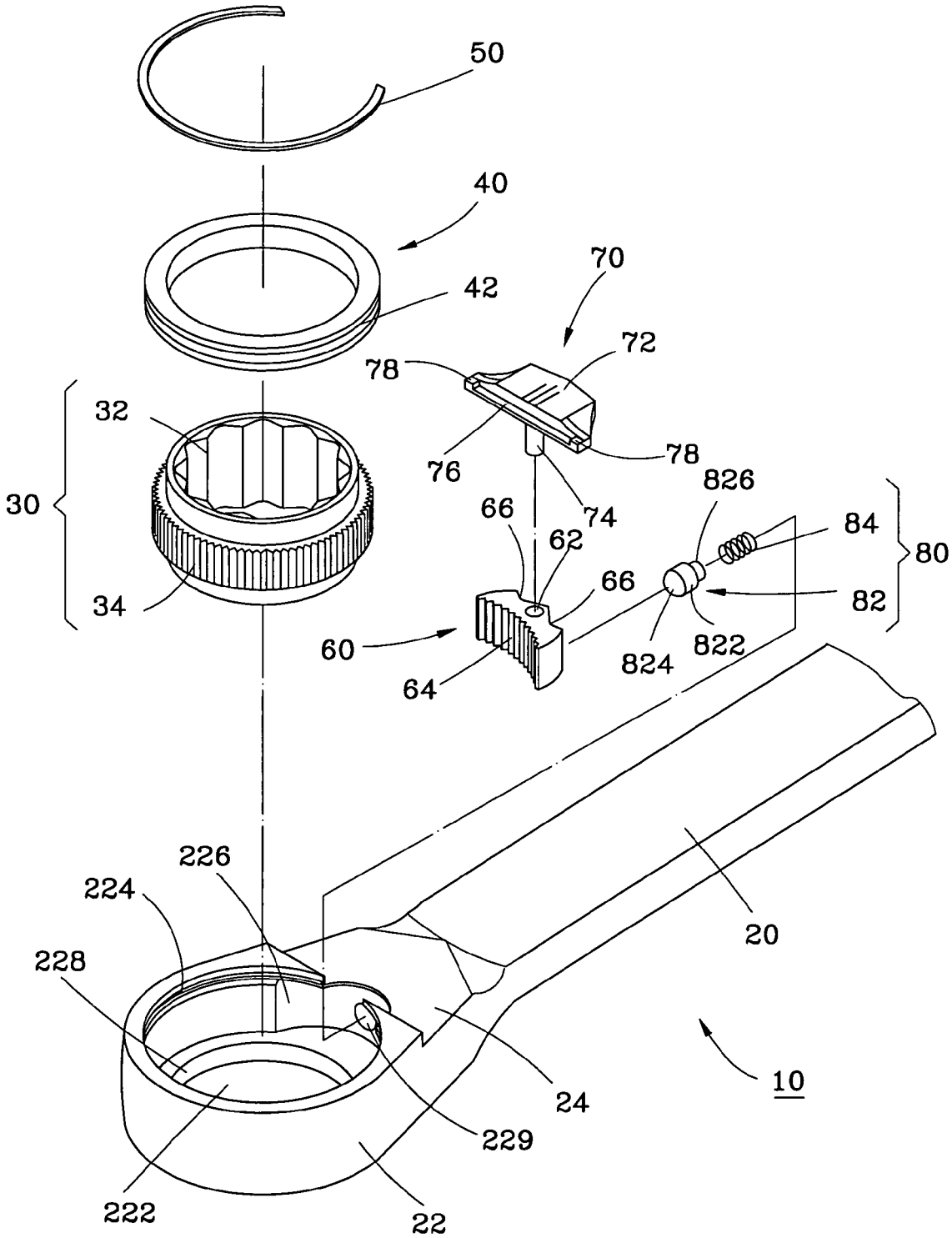
FIG. 2 is an exploded view of the ratchet wrench according to the preferred embodiment of the present invention.
Figure 5:
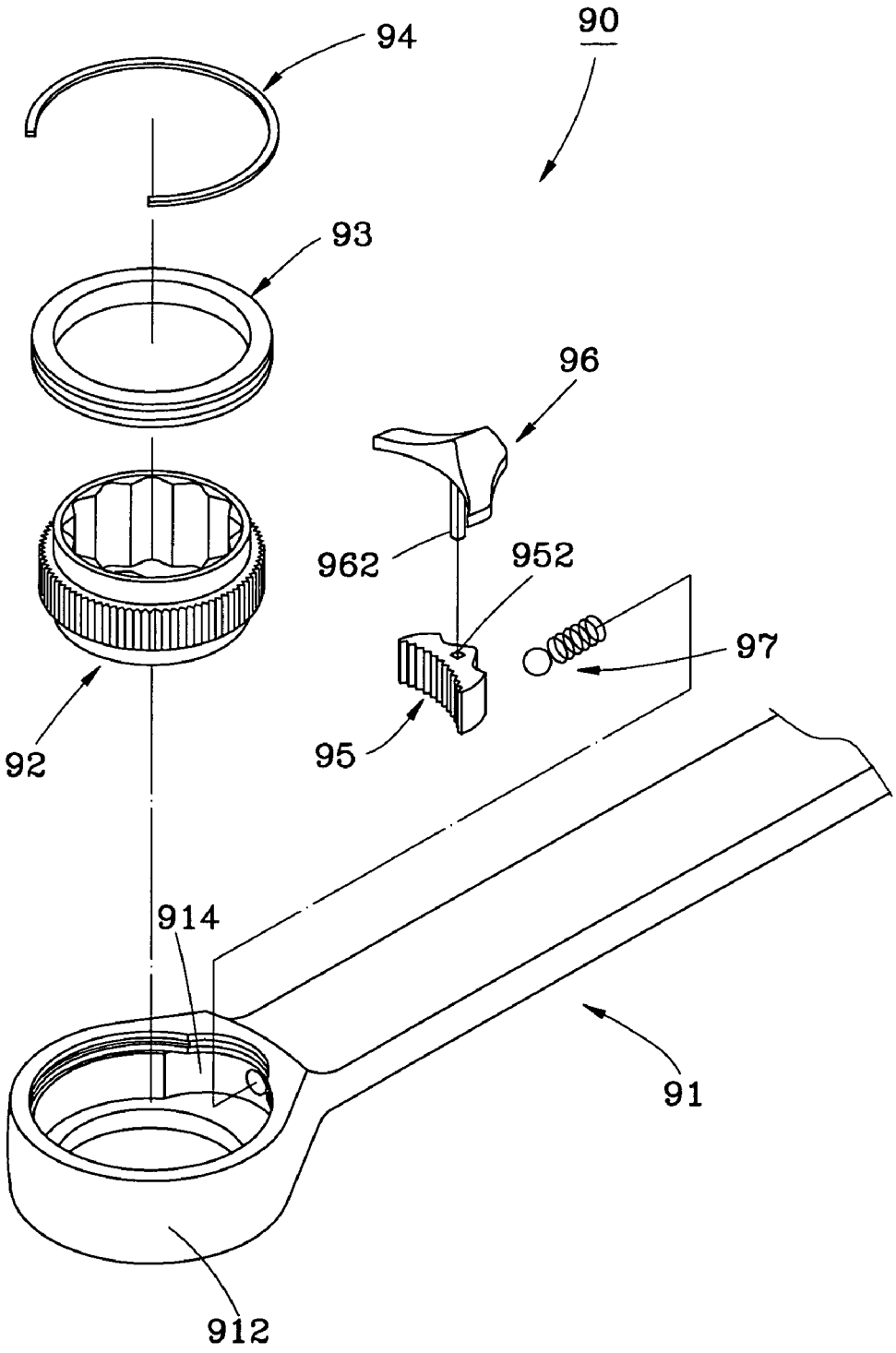
FIG.5 PRIOR ART
FIG. 5 is an exploded view of a ratchet wrench according to the prior art.

Referring to FIGS. 1 and 2, a ratchet wrench 10 in accordance with the preferred embodiment of the present invention is shown comprising a handle 20, a driving member 30, a mounting ring 40, a retainer 50, a pawl 60, a slider 70, and a positioning device 80.

The handle 20 is a metal bar, having a head 22 at one end. The head 22 has a through hole 222 through the top and bottom sides, a locating groove 224 extending around the inside wall within the through hole 222 near the top side, an arched receiving portion 226 curved inwards in the inside wall at one side, an inside annular stop flange 228 inwardly projecting from the inside wall into the through hole 222 at the bottom side, and a circular blind hole 229 axially extending from the center of the arched receiving portion 226 into the inside of the handle 20. The handle 20 further has an inwardly recessed bearing portion 24 at the top side corresponding to the top edge of the arched receiving portion 226.

The driving member 30 is an annular stem having an axially extending dodecagonal center coupling hole 32, and a toothed portion 34 around the periphery. The driving member 30 is mounted in the through hole 222 of the head 22 of the handle 20 and supported on the inside annular stop flange 228.

The mounting ring 40 is a metal ring capped on the driving member 30 and supported on the top side of the toothed portion 34, having an outside annular groove 42 extending around the periphery.

The retainer 50 is a C-shaped metal retaining ring fastened to the outside annular groove 42 of the mounting ring 40 and engaged in the locating groove 224 inside the head 22 of the handle 20 to secure the driving member 30 to the head 22 of the handle 20, allowing the driving member 30 to be rotated in the head 22. Further, the opening of the C-shaped retainer 50 is set corresponding to the bearing portion 24 and arched receiving portion 226 of the handle 20.

The pawl 60 is an arched block, having a vertical locating hole 62 extending through the top and bottom sides, a toothed front wall 64, and two locating grooves 66 symmetrically bilaterally disposed at the back side. The pawl 60 is mounted in the arched receiving portion 226 with the toothed front wall 64 facing the driving member 30 so that the toothed front wall 64 can be forced into engagement with the toothed portion 34 of the driving member 30.

The slider 70 comprises a head 72 and a body 74. The head 72 of the slider 70 has a front flange 76 and two stop blocks 78 at two opposite lateral sides of the front flange 76. The body 74 is a cylindrical member downwardly extending from the bottom side of the head 72. The body 74 of the slider 70 is inserted into the locating hole 62 of the pawl 60, keeping the head 72 of the slider 70 closely attached to the bearing portion 24 of the handle 20 and the front flange 76 inserted into the outside annular groove 42 of the mounting ring 40, therefore the slider 70 can be moved along the outside annular groove 42 of the mounting ring 40 to carry the pawl 60. Further, when moving the slider 70 along the outside annular groove 42 of the mounting ring 40, the stop blocks 78 are selectively stopped at the periphery of the mounting ring 40, preventing locking of the slider 70 due to engagement of a part thereof into the outside annular groove 42 of the mounting ring 40.

The positioning device 80 is mounted in the circular blind hole 229 inside the handle 20, comprised of a stop rod 82 and a spring member 84. The stop rod 82 comprises a shank 822, a round head 824 at one end of the shank 822 and a cylindrical tip 826 at the other end of the shank 822. The round head 824 is stopped at one locating groove 66 of the pawl 60. The diameter of the cylindrical tip 826 is smaller than the shank 822. The spring member 84 is sleeved onto the cylindrical tip 826 of the stop rod 82 and stopped between the rear end of the shank 822 and the bottom wall of the circular blind hole 229. The spring member 84 imparts a spring force to the stop rod 82 to push the stop rod 82 toward the pawl 60 against the driving member 30.

Figure 3:
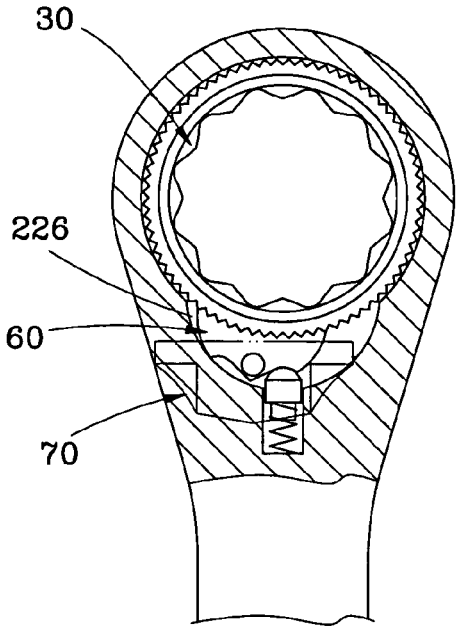
FIG. 3 is a sectional view taken along line 3—3 of FIG. 1, showing the pawl stopped at the driving member for allowing counter-clockwise rotation of the driving member in the head of the handle.
Figure 4:
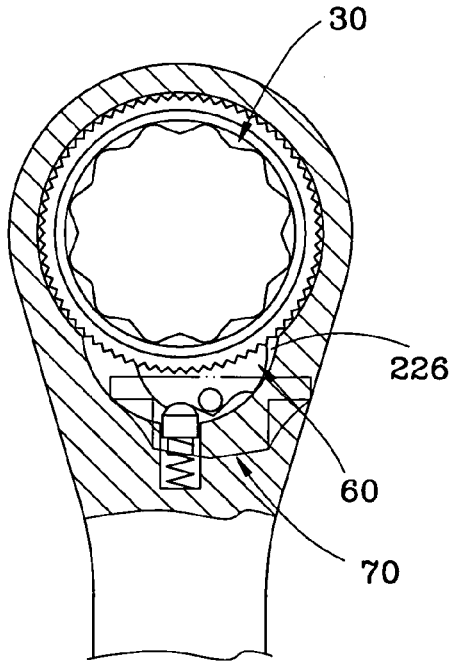
FIG. 4 is similar to FIG. 3 but showing the pawl stopped at the driving member in another position for allowing clockwise rotation of the driving member in the head of the handle.

Referring to FIGS. 1 and 2 again, the head 22 and bearing portion 24 of the handle 20 are formed through a milling and cutting processing procedure. During assembly process, the stop rod 82 and the spring member 84 are set in the circular blind hole 229 of the handle 20, and then the pawl 60 is directly put in the arched receiving portion 226 inside the head 22 of the handle 20 to force one locating groove 66 into engagement with the stop rod 82, and then the driving member 30 is secured to the through hole 222 of the head 22 of the handle 20 by means of the mounting ring 40 and the retainer 50 to force the toothed portion 34 into engagement with the toothed front wall 64 of the pawl 60, and then the body 74 of the slider 70 is inserted into the locating hole 62 of the pawl 60. At this time, the bottom side of the head 72 of the slider 70 is closely attached to the arched bearing portion 24 of the handle 20, keeping substantially the top edge of the slider 70 in flush with the top edge of the head 22 of the handle 20. Thus, the user can move the slider 70 to shift the pawl 60 relative to the positioning device 80 and to alternatively force one of the two locating grooves 66 into engagement with the round head 824 of the stop rod 82, thereby controlling the direction of rotation of the driving member 30 in the head 22 of the handle 20. FIG. 3 shows the slider 70 carried the pawl 60 to one side (the left side) of the arched receiving portion 226, allowing counter-clockwise rotation of the driving member 30 in the head 22 of the handle 20. FIG. 4 shows the slider 70 carried the pawl 60 to the other side (the right side) of the arched receiving portion 226, allowing clockwise rotation of the driving member 30 in the head 22 of the handle 20. In general, the invention provides a ratchet wrench, which is easy to assemble and convenient to use.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A ratchet wrench comprising:

a handle having a head at one end and a bearing portion recessed inwards in a top wall thereof and abutted to said head, said head having a through hole through top and bottom sides thereof, a locating groove extending around an inside wall thereof within said through hole, a receiving portion curved inwards in said inside wall at one side;

a driving member rotatably mounted in the through hole of the head of said handle, said driving member having an axially extending center coupling hole, and a toothed portion extending around a periphery thereof;

a mounting ring capped on said driving member, said mounting ring having an outside annular groove extending around a periphery thereof;

a retainer fastened to the outside annular groove of said mounting ring and engaged in the locating groove inside the head of said handle to secure said driving member to the head of said handle;

a pawl mounted in the receiving portion inside the head of said handle, said pawl having a toothed front wall meshed with the toothed portion of said driving member;

a slider fastened to said pawl for moving along said bearing portion of said handle to move said pawl relative to said driving member, said slider having a front flange inserted into the outside annular groove of said mounting ring for enabling said slider to be moved along the outside annular groove of said mounting ring; and a positioning device mounted in said receiving portion inside the head of said handle for supporting said pawl against said driving member.

2. The ratchet wrench as claimed in claim 1, wherein said slider is attached to said bearing portion of said handle, keeping substantially a top edge thereof in flush with the topmost edge of the head of said handle.

3. The ratchet wrench as claimed in claim 1, wherein said pawl has a round locating hole; said slider has a top head attached to said bearing portion of said handle, and a bottom body inserted into the round locating hole of said pawl.

4. The ratchet wrench as claimed in claim 1, wherein said slider has two stop blocks extended from two opposite lateral sides of the front flange thereof and selectively stopped at the periphery of the mounting ring.

5. The ratchet wrench as claimed in claim 1, wherein said positioning device comprises a stop rod for stopping against said pawl, and a spring member mounted in a blind hole in said receiving portion inside said head of said handle and stopped between one end of said stop rod and a bottom wall of said blind hole in said receiving portion inside said head of said handle to force said stop rod against said pawl.

* * * * *